United States Patent [19]

Gauss et al.

[11] 4,058,811

[45] Nov. 15, 1977

[54] ENCAPSULATED BASE FOR WHIP ANTENNA

[75] Inventors: Robert C. Gauss; Lynn D. Wills, both of Schaumburg, Ill.

[73] Assignee: Motorola, Inc., Schaumburg, Ill.

[21] Appl. No.: 668,994

[22] Filed: Mar. 22, 1976

[51] Int. Cl.[2] ..... H01Q 1/32; H01Q 1/50

[52] U.S. Cl. ..... 343/715; 343/860; 343/873

[58] Field of Search ..... 343/715, 749, 860, 900, 343/906, 745, 873

[56] References Cited

U.S. PATENT DOCUMENTS

| | | | |
|---|---|---|---|
| 2,944,257 | 7/1960 | Martin | 343/749 |
| 3,264,647 | 8/1966 | Nuttle | 343/900 |
| 3,545,148 | 12/1970 | Mandino | 343/715 |
| 3,944,722 | 3/1976 | Larsen | 343/715 |
| 3,977,005 | 8/1976 | Cejka | 343/715 |

*Primary Examiner*—Eli Lieberman

*Attorney, Agent, or Firm*—James W. Gillman; Victor Myer

[57] ABSTRACT

A hermetically sealed mobile antenna base containing all of the components necessary to proper antenna functioning with the exception of the loading coil and antenna whip for vehicular application is disclosed. A single connector screw extends outwardly from the base casting and is insulated therefrom by an insulating washer. Interiorly of the base casting an impedance matching capacitor is disposed with one lead connected to the connector screw and the other lead connected to ground. The coaxial cable is led into the base casting and has its center conductor connected to the connecting screw and its ground conductor connected to the casting. The complete interior of the base casting is encapsulated with an epoxy compound. Spaced apart connection ears extend from one side of the base casting providing for attachment of the antenna base to the vehicle.

6 Claims, 4 Drawing Figures

Fig. 1
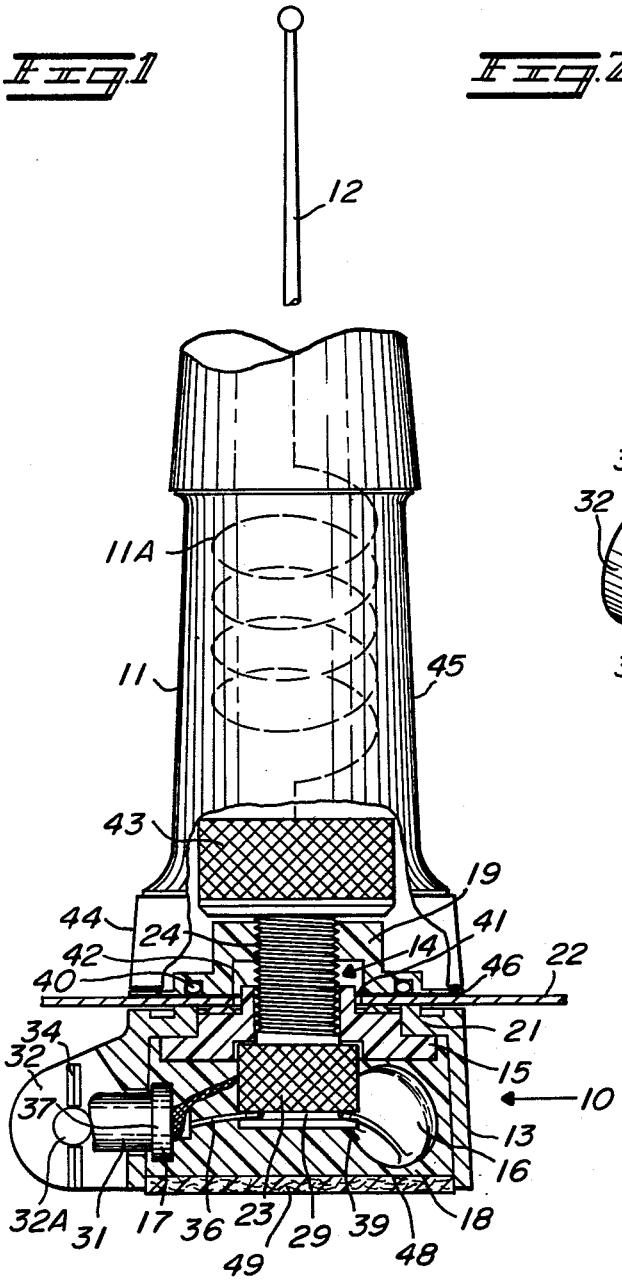
Fig. 2
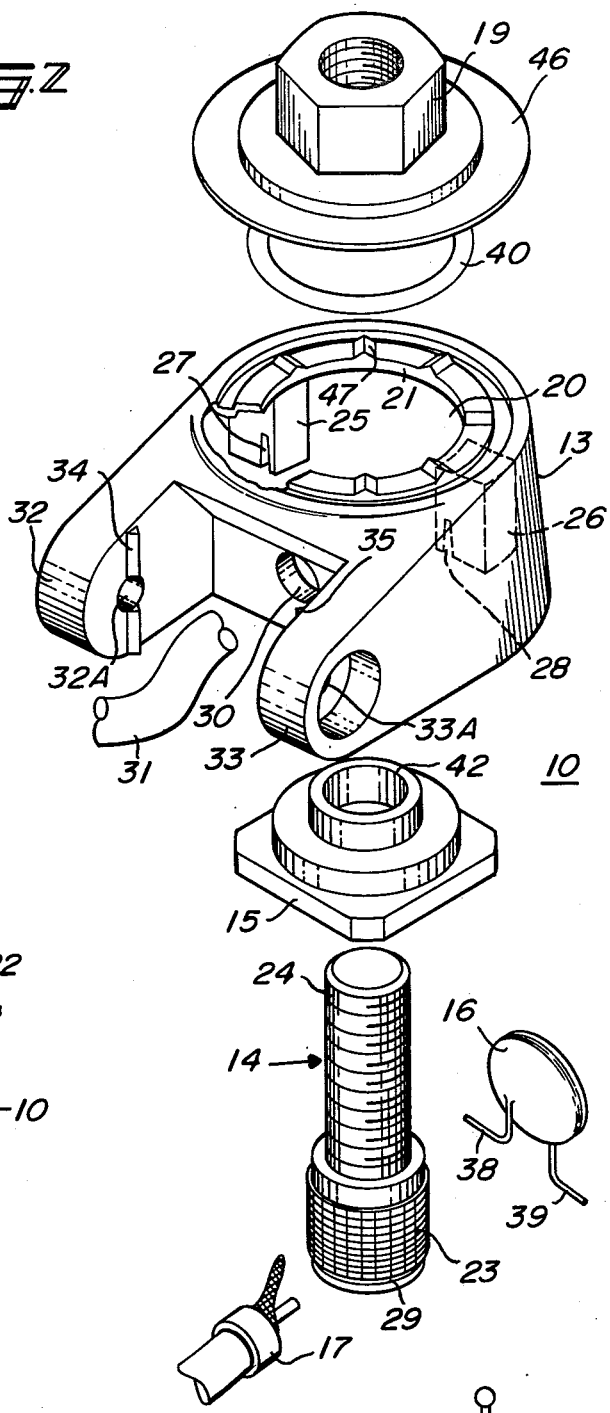
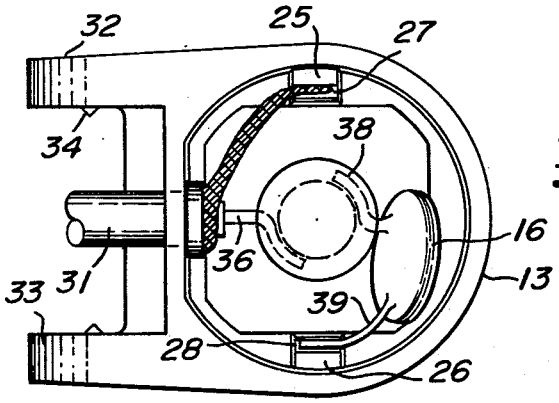
Fig. 3
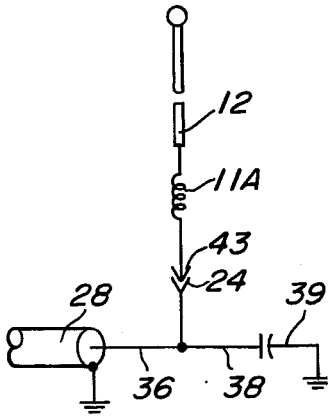
Fig. 4

ENCAPSULATED BASE FOR WHIP ANTENNA

RELATED APPLICATIONS

This application is related to the application of Hemi P. Sathe, Robert C. Gauss, and Lynn D. Wills, Ser. No. 669,001, filed Mar. 22, 1976, entitled Antenna Assembly and Method of Manufacture, and assigned to the same assignee as the subject invention.

BACKGROUND OF THE INVENTION

This invention relates to mobile antennas and more particularly to the bases for supporting such antennas wherein the base includes all of the necessary antenna functions with the exception of the loading coil and whip.

Heretofore, known antenna bases have required field assembly and were not permanently sealed. Accordingly they were subject to damage by vibrations and other shocks, nor did they provide sufficient strain relief to the cable leading from the vehicle transmitter. Moreover such known antenna bases tended to erode the mounting surface of the vehicle to which the base was attached.

SUMMARY OF THE INVENTION

It is an object of the invention to provide an improved mobile antenna base which overcomes the objections of the prior art constructions.

It is a further object of the invention to provide an improved antenna base of the nature indicated which does not require any field assembly or adjustment and is completely, or hermetically, sealed.

It is a further object of the invention to provide an improved antenna base of the nature indicated which is efficient, and is inexpensive to manufacture.

An antenna base, according to the invention, provides a termination point for the coaxial cable which leads to the radio, provides a housing for a portion or portions of the loading, or matching, network, hermetically seals these components and terminals, provides means whereby a variety of mounting hardware may be attached and prevents abrasion of the mounting surface.

In carrying out the invention according to one form there is provided a base member for coupling to an antenna whip comprising, a metallic housing, a contact member having one part extended upwardly from the housing for coupling to the antenna whip and a second part extending into the interior of such housing, a capacitor interiorly of the housing and having one lead connected to said contact member for impedance matching, the housing having means for receiving signal conducting means such as coaxial cable, the signal conducting means extending into the housing and including a ground conductor and a signal conductor, the signal conductor being connected to the second part of the contact member interiorly of the housing and the ground conductor being connected to the housing interiorly thereof, the capacitor having a second lead connected to the housing interiorly thereof, and insulating means encapsulating the capacitor, the second part of the contact member, the signal conducting extension and the connections interiorly of said casing.

In carrying out the invention according to a second form the encapsulating means does not fill the space completely and the remaining space is filled with a resilient pad to keep the metal parts of the housing out of contact with the metal of the vehicle and laterally extending spaced apart members are attached to the base for attachments thereof to the vehicle or other support.

BRIEF DESCRIPTION OF THE DRAWINGS

FIG. 1 is an elevational view, partially in section, of the antenna base according to the invention;

FIG. 2 is an exploded perspective view of the antenna base;

FIG. 3 is a bottom view in a partially completed state taken substantially in the direction of the arrows 3—3 of FIG. 1; and FIG. 4 is a circuit diagram of the electrical components.

DESCRIPTION OF THE PREFERRED EMBODIMENT

Referring to the drawings there is shown a base 10 connected to an encased loading coil 11 from which extends the antenna whip 12 as more specifically shown in the application Ser. No. 669,001, referred to.

The base 10 comprises a metallic housing, or skirt, 13, a single contact member 14, or connecting screw, an insulating member, or washer, 15, a capacitor 16, a coaxial cable termination 17, a filling, or encapsulation 18 and an insulating nut 19.

Base 10 which may be of cast metal, if desired, is open at the bottom as shown and is provided with a circular opening 20 at the top which has a diameter less than the outer diameter of the skirt 13 in order to form a shelf 21 for resting against the attaching metal 22 of the vehicle in the event that that is the mode of attachment of the antenna to the vehicle.

The connecting screw (contact member) 14 includes a knurled base portion 23 disposed within the skirt 13, the insulating washer 15 being adapted to be disposed between the connecting screw stud portion 24 and the opening 20. Interiorly of the skirt 13 there are a pair of embossments 25 and 26, the lower portions of which include slots 27 and 28, respectively. The base portion 23 of the connecting screw also has a slot, or groove, 29 for receiving conductors as will be described. The casting of skirt 13 includes an opening 30 through which the coaxial cable 31 to the Citizens Band radio is received. Spaced apart ears 32 and 33 extend from the casting 13 and are provided with bores 32A and 33A, respectively, through which screws may be received for attaching the antenna base 10 to a bracket (not shown) on the vehicle if this fashion of attachment is chosen. Sharp protuberances 34 and 35 may be provided on the interior surfaces of the ears 32 and 33, respectively, for assistance in this aspect.

The center conductor 36 of the coaxial cable 28 is crimped to the base 23 at the slot 29 and the braid or ground 37 of the coaxial cable is crimped to the embossment 25 at the slot 27 for example.

The capacitor 16 of the appropriate capacitive value is disposed interiorly of the skirt 13 and has two terminals or leads 38 and 39. Lead 38 is attached to the base portion 23 by crimping to the slot 29 as shown, and the lead 39 is attached to the embossment 26, as for example, by crimping, at slot 28 as shown. The foregoing description may be visualized in FIG. 3 wherein the components are shown unencapsulated.

When the connecting screw 14, the capacitor 16, the washer, or insulator 15, and the coaxial cable 31 and strain relief termination 17 are disposed in position and the connections as described are made, all as shown, for example, the space inside of the skirt 13 is filled with an epoxy compound. This completely encapsulates all of the components referred to and forms an integral unitary structure, hermetically sealing these components so that only a single contact point, namely the threaded stud 24 of screw 14 protrudes from the base for connection to the antenna proper. The capacitor 16 forms part of an impedance matching network extending between the input coaxial cable 31 and the antenna loading coil 11 whereby a voltage standing wave ratio of no greater than 2:1 is maintained throughout the band, without further adjustment either at the factory, after assembly, or at the place of installation.

If the antenna is to be installed by attaching to the metal 22 of a vehicle, an opening 41 is provided therein through which the stud 24 of the connecting screw is received and surrounding which an inner sleeve 42 of the insulating washer 15 is received thereby insulating the center connector 14 from the vehicle metal. The threaded stud 24 is then received in the insulating nut 19 this nut then being screwed down until the antenna base is held securely against the under portion of the vehicle metal. An "0" ring 40 may be used to provide weatherproofing of the opening 41. The portion of the threaded stud 24 protruding above the insulating nut 19 is then received in the threaded nut 43 of the antenna. The antenna is screwed down until the skirt portion 44 of the molded outer cover 45 bottoms on the flange 46 of the insulating nut 19, which protects the painted finish of the vehicle metal from abrasion and firmly holds the antenna to the vehicle. If the antenna is attached to the vehicle by virtue of the ears 32 and 33, the antenna is screwed to the projecting stud 24 until the bottom of the skirt 44 engages the outer periphery of the shelf 21. This gives the single point contact between antenna and base. The insulating nut 19 is removed in this instance.

The shelf portion 21 includes extending lugs or protuberances 47 which engage the under surface of the vehicle metal 22 to give a firmer attachment thereto and a good ground connection as well.

The lower surface 48 of the epoxy encapsulating compound does not extend to the rim of skirt 13. The remaining space is filled with a resilient pad 49 to avoid contact of the rim with the finish of the vehicular surface.

Referring to FIG. 4, the antenna circuit, as connected to a vehicle, is shown, the reference characters in this figure being the same for corresponding parts as in the previous figures. Thus the antenna whip 12 is connected to the loading coil 11 (turns 11A shown dotted) which ends in a single connector nut 43. The nut receives the single stud 24 which is connected to the center conductor 36 of the coaxial cable 28 and the capacitor 16 has one lead 38 connected to the stud 24 and another lead 39 connected to ground. The capacitor 16 matches the inductive effect of the combined loading coil 11A and whip 12 to the impedance of the coaxial cable 31 throughout the frequency band.

At some point throughout the frequency band the circuit comprising the whip 12, the coil (turns) 11A, etc., capacitance 16 will be resonant, and at other frequencies the circuit will be removed from resonance but never sufficiently far to make the standing wave ratio greater than 2:1 throughout the whole frequency band.

According to one form of the invention described, the inductance value of the coil 11A was 5 micro henries, the capacitance value of the whip was 7 picofarads, and the capacitance value of capacitor 16 was 160 picofarads. The dielectric constant of the material encapsulating the coil 27 is between 2.4 and 3.8. The band width of the Citizens Band is 26.965 to 27.255 MHz, and it is this band width that the constants set out in the foregoing specification have been selected for in order to give a standing wave ratio of not greater than 2:1 throughout the band width.

The length of the whip was 49.25 inches, the coil 11A consisted of 20 turns of No. 14 AWG copper wire and the diameter of the turns was 0.750 inches.

Other constants, of course, may be used, for other frequency bands, or conditions of operation.

We claim:

1. A base member for coupling to an antenna whip comprising, a metallic housing, a contact member having one part extending upwardly from said housing for coupling to said antenna whip and a second part extending into the interior of said housing, an insulating member separating said one part from said housing, a capacitor interiorly of said housing and having one lead connected to the second part of said contact member for impedance matching, said housing having an opening for receiving signal conducting means, signal conducting means having an extension projecting through said opening into said housing and including a ground conductor and a signal conductor, said signal conductor being connected to said second part interiorly of said housing and said ground conductor being connected to said housing interiorly thereof, said capacitor having a second lead connected to said housing interiorly thereof, and insulating means encapsulating said capacitor, said second part, said signal conducting extension and the connections interiorly of said casing.

2. The base member according to claim 1 wherein said encapsulating means stops short of the extremity of said housing and a resilient member terminates said encapsulating means.

3. The base member according to claim 1 wherein said housing includes laterally extending spaced apart member for attaching said base to a support.

4. The base member according to claim 1 wherein the interior surface of said housing includes a protruding member to which said ground conductor is connected.

5. A base member according to claim 1 wherein the antenna whip is coupled to a sheet metal surface of a vehicle including an insulating nut for said one part wherein said one part protrudes through said sheet metal surface.

6. The base member according to claim 4 wherein the interior surface of said housing includes a further protruding member to which said second lead of said capacitor is connected.

* * * * *